US006600392B2

(12) United States Patent
Kim et al.

(10) Patent No.: US 6,600,392 B2
(45) Date of Patent: Jul. 29, 2003

(54) METAL WINDOW FILTER ASSEMBLY USING NON-RADIATIVE DIELECTRIC WAVEGUIDE

(75) Inventors: Young Su Kim, Ulsan (KR); Young Geun Yoo, Ulsan (KR)

(73) Assignee: NRD Co., Ltd., Ulsan (KR)

( * ) Notice: Subject to any disclaimer, the term of this patent is extended or adjusted under 35 U.S.C. 154(b) by 36 days.

(21) Appl. No.: 09/983,084

(22) Filed: Oct. 23, 2001

(65) Prior Publication Data

US 2003/0006865 A1 Jan. 9, 2003

(30) Foreign Application Priority Data

Jul. 3, 2001 (KR) ..... 2001-39579

(51) Int. Cl.[7] ..... H01P 1/208
(52) U.S. Cl. ..... 333/208; 333/212; 333/210
(58) Field of Search ..... 333/208, 212, 333/210, 219, 219.1, 239, 248

(56) References Cited

U.S. PATENT DOCUMENTS 5,416,492 A * 5/1995 Takahashi et al. ..... 343/771
6,331,809 B1 * 12/2001 Takakuwa et al. ..... 333/135
6,486,753 B1 * 11/2002 Kim ..... 333/208

* cited by examiner

*Primary Examiner*—Robert Pascal
*Assistant Examiner*—Stephen E. Jones
(74) *Attorney, Agent, or Firm*—Nixon Peabody LLP; Thomas W. Cole

(57) ABSTRACT

Disclosed is a metal window filter assembly, of a millimeter wave band, using an NRD guide. The filter assembly comprises a filter housing including parallel conductive plates and a filter for filtering a certain frequency band of an electromagnetic wave traveling therethrough. The filter includes a plurality of polygonal metal windows and a single body type dielectric line made from a non-radiative dielectric. A plurality of polygonal inserting grooves spaced by the predetermined distance are formed respectively on both surfaces of the dielectric line making contact with the parallel conductive plates. The metal windows are inserted in the inserting grooves one to one to form multi-staged dielectric resonators cascaded as a single body. The filter has a filtering function selectively passing the certain frequency band determined by an impedance coupling relationship that the multi-staged dielectric resonators have with respect to the electromagnetic wave. The filter assembly is suitable for a commercial use due to its simple structure, a small loss and superiority in processing, assembly and productivity.

11 Claims, 13 Drawing Sheets

METAL WINDOW FILTER ASSEMBLY USING NON-RADIATIVE DIELECTRIC WAVEGUIDE

BACKGROUND OF THE INVENTION

1. Field of the Invention

The present invention relates to a filter in a millimeter wave band, and more particularly to a millimeter wave band filter to which the technology of a non-radiative dielectric waveguide ("NRD guide") is applied.

2. Description of Prior Art

An NRD guide circuit has attracted attention as a transmission line for a micro wave band, particularly a millimeter wave band above 30 GHz, due to its small transmission loss in comparison with a microstrip line and due to its easiness in manufacturing the transmission line in comparison with prior waveguides.

The structure of a general prior NRD guide circuit is illustrated in FIG. 1. The NRD guide circuit has a structure that a dielectric line 10 through which an electromagnetic wave is transmitted is sandwiched between two parallel conductive plates 12*a,* 12*b* made from conductive metal. A space h of the two parallel plates 12*a,* 12*b* is less than half a free space wavelength of a using frequency. Accordingly, the electromagnetic wave is blocked in places other than the dielectric line 10 and its radiation is restricted, so that the NRD guide circuit can transmit the electromagnetic wave along the dielectric line 10 at a small loss. Paying attention to such transmission superiority of the NRD guide circuit, there have been proposed NRD guide filters of the 35 GHz and 50 GHz bands.

FIGS. 2 and 3 are perspective views illustrating the structure of a prior air gap coupled filter using an NRD guide. The prior air gap coupled filter has a structure that multi-staged dielectric blocks are sandwiched between the parallel conductive plates 12*a,* 12*b*. One dielectric line is cut into plural dielectric blocks with proper lengths. The dielectric blocks 14*a*~14*e* are aligned in a line, with maintaining certain gaps therebetween, in the direction to which a signal proceeds and is air gap coupled with dielectric lines 10*a,* 10*b* on input and output sides, respectively. Each of the dielectric blocks operates as a dielectric resonator at each stage of the filter. The number of the dielectric resonator blocks is proportional to a filtering order number of the filter. The air gap coupled filter shown in FIG. 2 is the fifth order filter because it has five dielectric resonator blocks 14*a*~14*e*.

The typical raw material for the dielectric line of the NRD guide which is applicable to millimeter waves is teflon. Teflon has an advantage that transmission loss is small whereas it has such disadvantages arising from its material characteristic that its processing is difficult due to its weakness and that its assembly is difficult because it does not easily adhere to other materials like metal. These disadvantages are the reason why the NRD guide has not been commercially used since the first introduction by Professor Yoneyama in the early 1980's.

Since the using frequency is as high as the millimeter wave band, a wavelength of the electromagnetic wave transmitted along the dielectric resonator blocks in the waveguide, i.e., within the parallel conductive plates, is very short. The characteristic of the filter, in this case, is sensitively changed in accordance with the physical dimensions of structural bodies and fixtures for setting the resonator. Thus, it is necessary not only that a length of each of the dielectric resonator blocks 14*a*~14*e* should be so accurately calculated as to resonate at a certain frequency within a passing band, but also that each of the dielectric resonator blocks should be made as precisely as a predetermined length so as to obtain a wanted characteristic of the filter.

Further, each of the multi-staged dielectric resonator blocks 14*a*~14*e* should be spaced a proper gap apart from its adjacent dielectric resonator blocks. This gap should be determined to obtain an optimal impedance matching between the two adjacent resonator blocks. That is, in order to obtain a good characteristic of a designed filter, there should be a precision of several microns not only in the length of each of the dielectric resonator blocks 14*a*~14*e* but also in the distance between the resonators.

However, in manufacturing the prior air gap coupled filter using the NRD guide, it is difficult to make the dielectric resonator blocks 14*a*~14*e* have such a precision. And also, with maintaining the precision of several microns, it is difficult to align the dielectric resonator blocks 14*a*~14*e* having different lengths in a straight line in the direction that a wave proceeds. In doing so, a lot of time and labor are required. Due to these reasons, the prior air gap coupled filter is a disadvantageous structure in terms of making, assembly and production, and is not suitable for a commercial model which is applicable to a high frequency in the millimeter wave band.

SUMMARY OF THE INVENTION

In order to improve the above problems, an object of the present invention is to provide a metal post filter assembly, using an NRD guide, which is designed for an easy making and a good productivity resulting from a convenient and accurate assembly and is capable of stably having filter characteristics to a wanted degree.

To accomplish the above object of the present invention, there is provided a metal window filter assembly using an NRD guide, comprising a filter housing which includes parallel conductive plates facing each other and a filter, disposed between the parallel conductive plates, for filtering a certain frequency band of an electromagnetic wave traveling therethrough, the filter including a plurality of polygonal metal windows and a single body type dielectric line made from a non-radiative dielectric, the dielectric line being formed with a plurality of polygonal inserting grooves which are spaced by the predetermined distance on first and/or second surfaces of the dielectric line making contact with the parallel conductive plates, and the metal windows being inserted in the inserting grooves one to one to form multi-staged dielectric resonators cascaded as a single body.

The metal windows provide discontinuous surfaces which radiate with respect to the electromagnetic wave. The multi-staged dielectric resonators have an impedance coupling relationship by the metal windows' positions and sizes and a reflection amount of, and a transmission amount of, the electromagnetic wave transmitted by the impedance coupling relationship is properly determined. As a result, the filter becomes to provide a filtering function selectively passing the certain frequency band.

It is preferable that an impedance of the multi-staged dielectric resonators is largest in a middle stage and becomes gradually and symmetrically smaller to both end stages.

For a phase compensation of the electromagnetic wave, it is preferable that a length of each stage of the dielectric resonators divided by the metal windows becomes gradually shorter from a middle stage to both end stages.

According to a preferred example of the filter, each of the inserting grooves has an identical width whereas depths of the inserting grooves become gradually and symmetrically deeper to a middle stage, and each of the metal windows has a substantially identical height with a depth of an inserting groove in which each such metal window is inserted and a depth of each of the metal windows is slightly wider than a width of an inserting groove in which each such metal window is inserted.

According to another preferred example of the filter, each of the inserting grooves has an identical depth whereas widths of the inserting grooves become gradually and symmetrically deeper to a middle stage, and each of the metal windows has a substantially identical height with a depth of an inserting groove in which each such metal window is inserted and a depth of each of the metal windows is slightly wider than a width of an inserting groove in which each such metal window is inserted.

Preferably, each of the metal windows is fixed as a single body on the parallel conductive plates.

Meanwhile, it is preferable that the filter assembly further comprises a plurality of tuning screws inserted, parallel to the parallel conductive plates toward the dielectric line, through both sidewalls of the filter housing, for tuning a resonance frequency of the filter by adjusting insertion lengths of the tuning screws.

The processing and assembling of the filter assembly is very simple according to the present invention. That is, the processing of major parts is completed once the inserting grooves are formed in the dielectric line made from a material which is difficult for processing, and once the metal windows respectively corresponding to the inserting grooves are arranged to form a straight line on inner surfaces of the parallel conductive plates. The assembling of the filter assembly is completed once the dielectric line is simply inserted in the parallel conductive plates of the filter housing to the effect that the metal windows are inserted in the corresponding inserting grooves.

Therefore, the filter assembly of the present invention has a simple structure and can remarkably reduce its manufacturing costs and maximize its productivity due to superior processing and assembling characteristics. Further, since the filter assembly of the present invention is designed to minimize the factors of error occurrence, the filter structure of the millimeter wave band which requires the precision of several microns can maintain the processing machine's precision and the filter characteristic to a designed degree without having an extra auxiliary zig.

Other characteristics and advantages of the present invention will become more apparent with reference to the following detailed description of the invention and the attached drawings illustrating the characteristics of preferred embodiments.

BRIEF DESCRIPTION OF THE DRAWINGS

The detailed description relating to the preferred embodiment of the present invention will be made with reference to the accompanying drawings.

DETAILED DESCRIPTION OF THE PREFERRED EMBODIMENTS

FIGS. 4 to 11 illustrate a filter assembly according to Embodiment 1. The filter assembly has a filter housing,100 including parallel conductive plates 30*a,* 30*b* which face each other and a filter 150, sandwiched between the parallel conductive plates 30*a,* 30*b,* for filtering a certain frequency band of an electromagnetic wave transmitted therealong.

Figure 1:
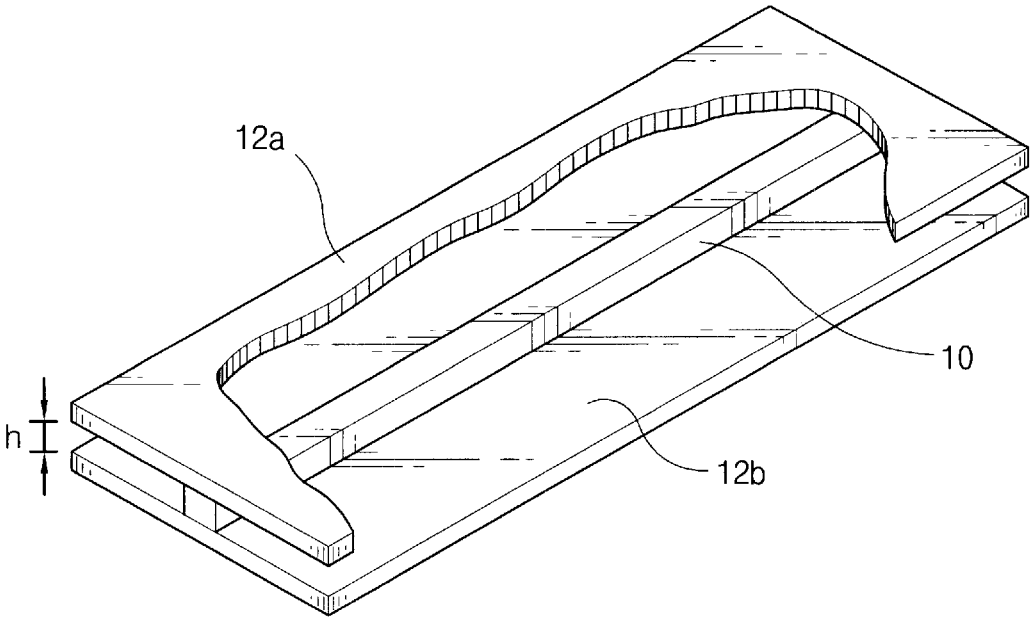
FIG. 1 (PRIOR ART)
FIG. 1 is a perspective view illustrating a prior art structure of an NRD guide.
Figure 2:
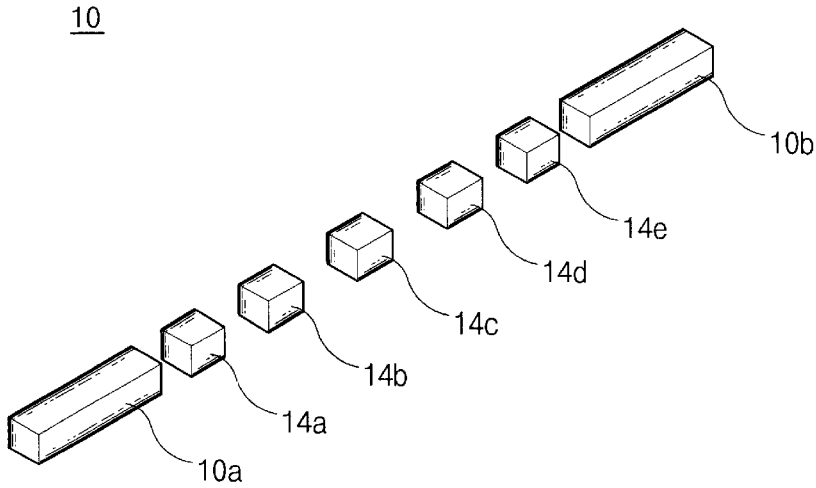
FIG. 2 (PRIOR ART)
FIG. 2 is a perspective view illustrating a dielectric line of a prior art air gap coupled filter using the NRD guide and a connecting manner of each of dielectric resonators.
Figure 3:
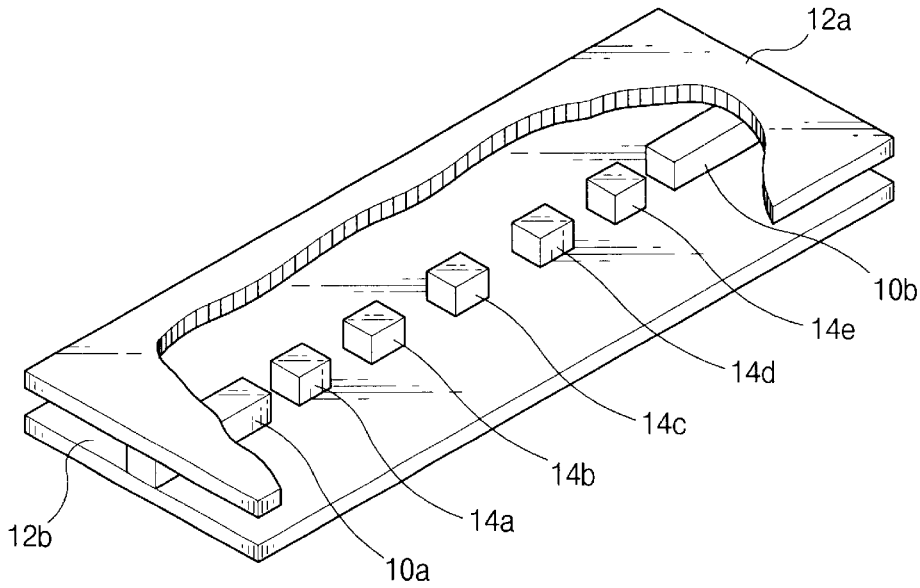
FIG. 3 (PRIOR ART)
FIG. 3 is a perspective view illustrating a structure of the prior art air gap coupled filter using the NRD guide.
Figure 4:
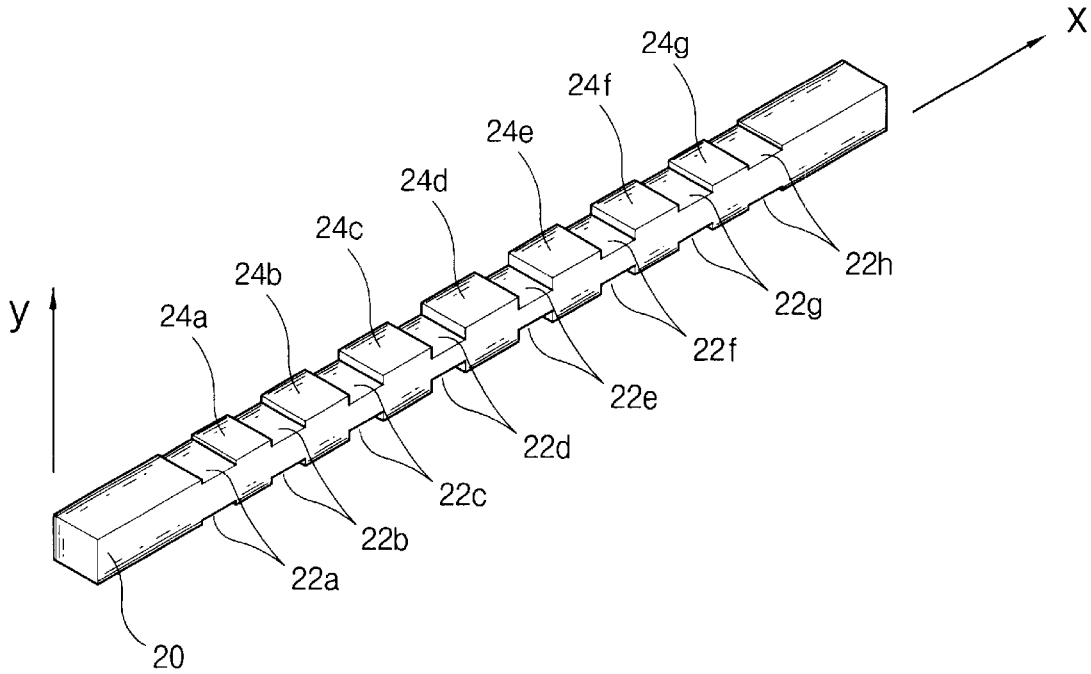
FIG. 4 is a perspective view illustrating a structure of a multi-staged dielectric resonator, as a dielectric line of a metal window filter assembly according to the first embodiment of the present invention, which is divided by a plurality of rectangular inserting grooves, in particular, each width of the rectangular inserting grooves being identical whereas each depth thereof from the middle stage to both end stages becomes gradually shallower.

The filter 150 includes a single body type dielectric line 20, made from a non-radiative dielectric material, and a plurality of polygonal metal windows 26*a*~26*h,* 28*a*~28*h.* In particular, a plurality of polygonal inserting grooves 22*a*~22*h,* each of which is spaced a certain distance apart from adjacent grooves, are formed respectively on first and second surfaces of the dielectric line 20 making contact with the parallel conductive plates 30*a,* 30*b* (refer to FIG. 4). The metal windows 26*a*~26*h,* 28*a*~28*h* are inserted in the inserting grooves 22*a*~22*h* on both surfaces one to one, respectively. As a result, the obtained filter 150 includes multi-staged dielectric resonators 24*a*~24*g* in which the dielectric line 20 is divided by the metal windows 26*a*~26*h,* 28*a*~28*h* and the multi-staged dielectric resonators 24*a*~24*g* are divided in a single body.

The filter 150 has a filtering function that selectively passes a certain frequency band determined by an impedance coupling relationship of the multi-staged dielectric resonators 24*a*~24*g* to the transmitted electromagnetic wave.

Hereinafter, the filter assembly of embodiment 1 is explained more in detail.

In FIG. 4, the dielectric line 20 is made in a long rectangular stick shape from a dielectric material like tefron and then the inserting grooves 22*a*~22*h* are formed, on both surfaces making contact with the filter housing, by being spaced at a predetermined distance along the longitudinal direction (the x-axis direction) of the dielectric line 20. Therefore, the dielectric line 20 is divided as the multi-staged dielectric resonators 24*a*~24*g* by the inserting grooves 22*a*~22*h*.

Figure 5A:
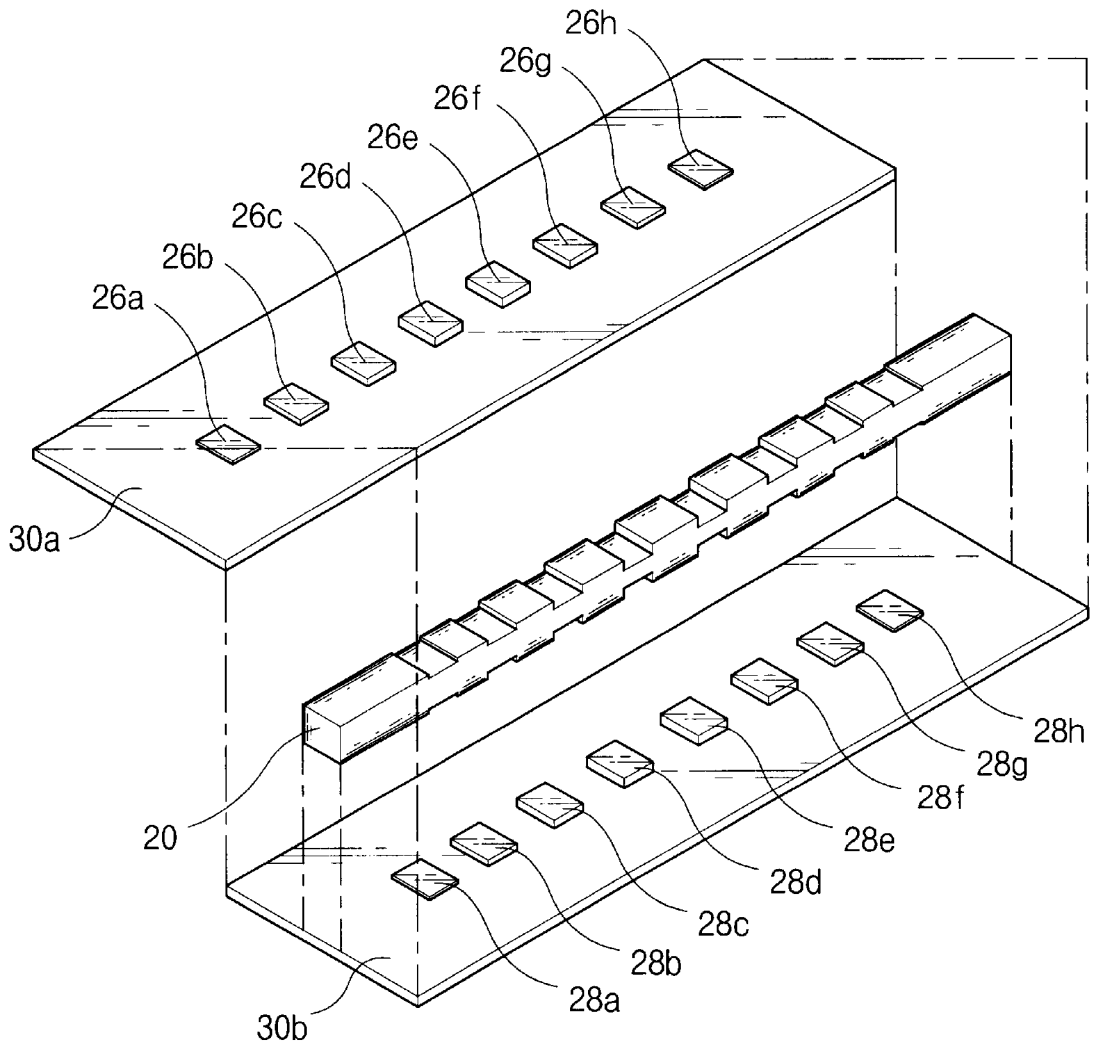
FIGS. 5A and 5B are an exploded perspective view of and a cut-open perspective view of an assembled state respectively illustrating structures of major parts of the filter assembly according to the first embodiment of the present invention.

FIG. 5A is an exploded perspective view explaining a feature that the dielectric line 20 made as the single body type is coupled between the parallel conductive plates 30*a*, 30*b*. Each of the parallel conductive plates 30*a*, 30*b* has a plurality of protruded rectangular plates, i.e., the metal windows 26*a*~26*h*, 28*a*~28*h*, made from metal in a position corresponding to each of the inserting grooves formed on the surface making contact with the dielectric line 20. A thickness of each metal window is designed to be identical to a depth of an inserting groove corresponding thereto. In FIG. 5A, structurally speaking, the metal windows 26*a*~26*h*, 28*a*~28*h* are fixed to the parallel conductive plates 30*a*, 30*b* as the single body, but functionally speaking, the metal windows 26*a*~26*h*, 28*a*~28*h* operate as the filter 150, together with the dielectric line 20. Taking account of a manufacturing convenience, although it is advantageous to make the metal windows 26*a*~26*h*, 28*a*~28*h*. and the parallel conductive plates 30*a*, 30*b* single bodies as shown, it does not. matter whether to make the metal windows separate components from the parallel conductive plates.

Figure 5B:
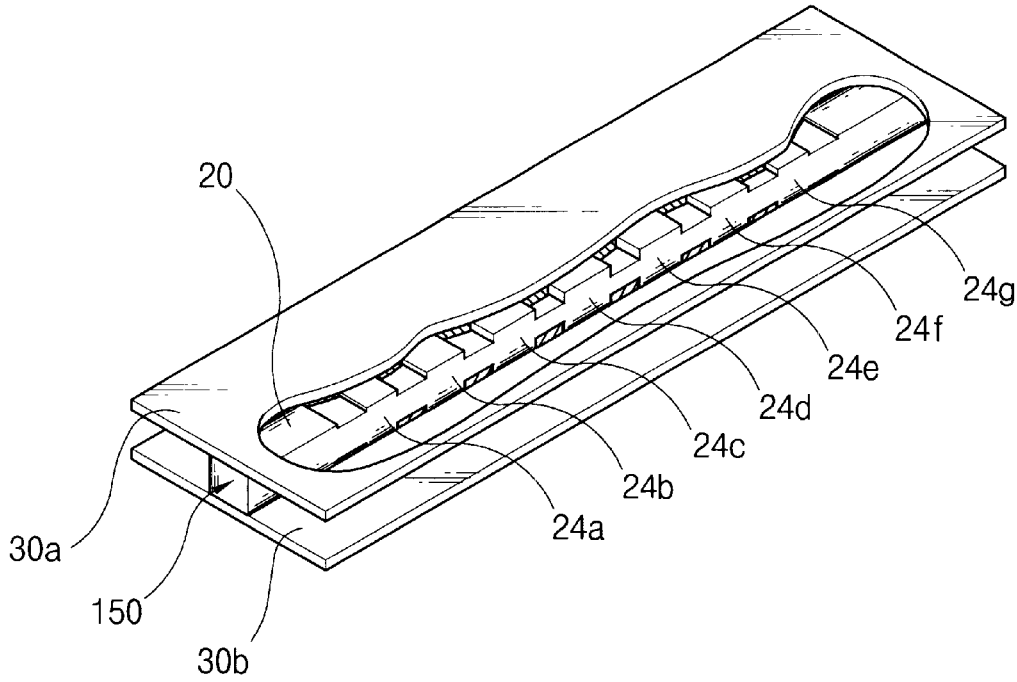

FIG. 5B is a cut-open perspective view illustrating a state that the exploded elements of FIG. 5A are assembled. The examples shown in FIG. 5B are major elements of the seventh order band pass filter. The illustrated filter assembly has a structure that the dielectric line 20 on which eight pairs of the inserting grooves 22*a*~22*h* are formed in advance as shown in FIG. 4 is assembled by being sandwiched between the parallel conductive plates 30*a*, 30*b* on which the metal windows are formed in advance. That is, the obtained filter 150 has the seven dielectric resonators, 24*a*~24*g* which are cascaded as a single body by inserting one to one the metal windows 26*a*~26*h*, 28*a*~28*h* which couple the dielectric resonators with each other by a proper impedance matching into each of the inserting grooves 22*a*~22*h*. The number of stages of the inserting grooves 22*a*~22*h* formed on the dielectric line 20 is proportional to a filtering order of the filter assembly. The number of the inserting grooves (or the number of the metal windows) can be determined in correspondence to a wanted filtering order.

The metal windows 26*a*~26*h*, 28*a*~28*h* can be made either from metal only or as a structure that metal having a superior conductivity is coated over a mold which is made from a certain material like synthetic resin or steel. In the latter, a thickness of a metal-coated stage shall be designed to be more than at least a skin depth. The example of a preferred material for manufacturing the metal windows is silver, copper, gold or aluminum which has a superior conductivity. The skin depth is not a fixed value, but a value which is determined according to the using frequency and the conductive characteristic of metal. The skin depths of silver and gold at a frequency band of 39 GHz are approximately 0.325 $\mu$m and 0.398 $\mu$m, respectively.

In sizing the respective lengths, in the x-axis direction, of the dielectric resonators 24*a*~24*g*, it is preferable that the middle stage, that is, the fourth dielectric resonator 24*d*, has the longest length and each of the rest from the fourth dielectric resonator 24*d* to the first and seventh dielectric resonators 24*a*, 24*g* at both end stages becomes gradually shorter. The reason that each length of the dielectric resonators is determined based on this way is that, since an impedance of each dielectric resonator becomes smaller to both end stages and, as a result, a phase difference of the electromagnetic wave occurs, it is considered to compensate the phase difference of the electromagnetic wave by gradually shortening the length of each dielectric resonator to both end stages.

The inserting grooves 22*a*~22*h* have an identical width W but have different depths D which are gradually shallower from the middle stages 22*d*, 22*e* to both end stages 22*a*, 22*h*. Since the dimensions of the metal windows are determined correlatively to the dimensions of the corresponding inserting grooves, a thickness of the metal windows should be identical to a depth D of the corresponding inserting grooves whereas a width L of the metal windows should be narrower than the width W of the corresponding inserting grooves so as to secure an air gap G. Therefore, a vertical distance of a pair of metal windows of each stage becomes narrowest at the middle stage, that is, at pairs of metal windows 26*d*, 28*d* and 26*e*, 28*e* whereas it becomes widest at both end stages, that is, at pairs of metal windows 26*a*, 28*a* and 26*h*, 28*h*. The dimensions of the inserting grooves and those of the metal windows are determined by a proper design equation to obtain an impedance matching at a resonance frequency of each stage.

The distribution of the electromagnetic wave traveling the dielectric resonator of each stage is denser at the center of the dielectric resonators whereas it becomes sparser towards the outside. The metal windows are interposed horizontally against the traveling direction of the electromagnetic wave along the dielectric line 20, so that they provide discontinuous surfaces which cause wave reflection. Therefore, a vertical distance of a pair of metal windows at a certain stage and an impedance value of the dielectric resonators at that stage have an inversely proportional relationship. According to the disposition of the metal windows shown in FIG. 5A or 5B, the respective impedances of the seven dielectric resonators are, for example, 110Ω, 130Ω, 160Ω, 200Ω, 160Ω, 130Ω and 110Ω, wherein the impedance is the biggest at the center stage and becomes gradually, and symmetrically smaller to both end stages. The electromagnetic wave is more reflected at the dielectric resonator of the middle stage whereas it is less reflected at the dielectric resonators of both end stages. Likewise, when the electromagnetic wave traveling along the dielectric line 20 meets the respective metal windows, reflection and loss happen in the electric field by a certain amount which is determined by each of boundary conditions between the dielectric resonators and the metal windows. After all, if the impedance value of each dielectric resonator is properly adjusted based on the disposed distance of the metal windows, a band-pass filter which selectively passes a certain band of frequency will be obtained. In general major factors which affect the impedance value of each dielectric resonator are the disposed position, number, dimensions, conductivity and external shape of the metal window. Therefore, a filter capable of filtering a wanted frequency component can be designed by applying such factors as proper values on the basis of the frequency band to be filtered.

One noteworthy feature of Embodiment 1 is that each width W of the inserting grooves 22*a*~22*h* has an identical value, accordingly their productivity is improved. It means that when the inserting grooves are cut by a milling machine, the cutting is possible by one tool kit without exchanging it with another wool kit. And also, if the dielectric line is designed not to have discontinuity in its length direction, it will be easy to manufacture the dielectric line 20 by injection molding or extrusion molding. The remaining uncut part of the dielectric line corresponds to the dielectric resonator of each stage of the filter 150. In manufacturing the dielectric resonators which can be positioned as precisely as several microns, such a difficult problem in positioning the prior air gap coupled filter in the right position during its assembly does not occur in the case of the filter assembly of this invention.

Figure 6:
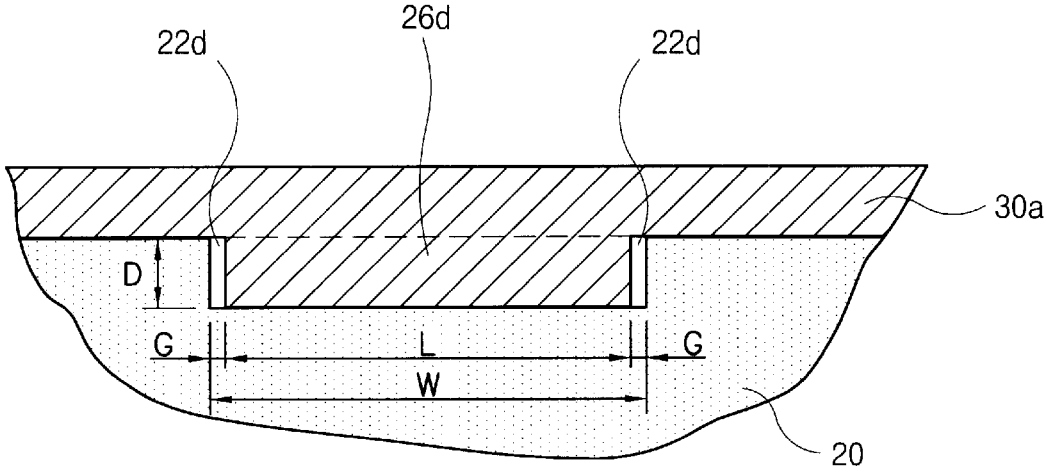
FIG. 6 is a view for explaining a role of air gaps defined by respective metal windows and the dielectric resonator of the metal window filter assembly according to the present invention.

FIG. 6 is an enlarged view for illustrating the state that one metal window is inserted in the corresponding inserting groove to the dielectric line. As mentioned above, there is an air gap 2G in a proper size between the metal window 26*d* and the insertion groove 22*d*. This air gap is of importance in terms of the following points. The dielectric line 20 is made from a dielectric material such as teflon which is weak in hardness. In the case that a width L of the metal window 26*d* to be inserted and a width W of the inserting groove 22*d* of the dielectric line are identical, the dielectric line 20 whose material characteristic in terms of hardness is soft may have a problem that, during an assembly process that the dielectric line 20 is positioned between the upper and lower conductive plates 30*a*, 30*b*, a length of the dielectric resonator may be shortened by being cut by the metal window. A resonance frequency of the more shortened dielectric resonator, in a short wave of the millimeter wave band, than a designed length shifts into a high frequency, and thus a passing band of the filter is, as a whole, shifted into a higher band than a designed one. From analyses, it has been found that when the length of the dielectric resonator is reduced as much as 10 micron or so, the resonance frequency increases as much as 12 MHz or so. Therefore, a secondary error which may arise during the assembly works can be fundamentally blocked by making the width L of the metal window for inserting smaller than the width W of the inserting groove. An influence on the field of the metal window filter by the air gap cannot be a problem because the influence is included in a designing stage, but errors occurring during the assembling works after the processing of the dielectric line 20 can be rather reduced by the air gap 2G.

Figure 7:
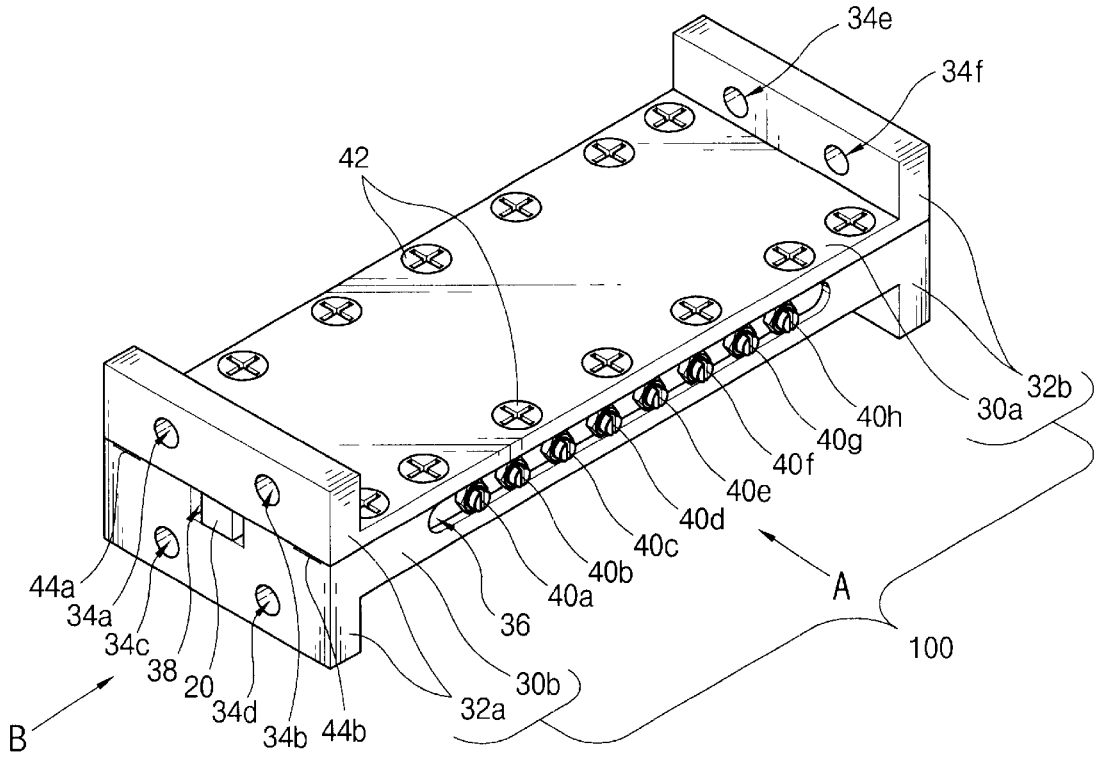
FIG. 7 is a perspective view illustrating the exterior of the metal window filter assembly according to the present invention.

FIG. 7 is a perspective view illustrating the exterior of a metal window filter assembly according to the present invention. The metal window filter assembly is made as a structure that the filter 150 is inserted in the filter housing 100. FIG. 5B is a view illustrating parts of the filter assembly of FIG. 7. The filter housing 100 includes the upper and lower conductive plates 30*a*, 30*b* in which a plurality of coupling holes 42' are formed. A plurality of bolts 42 bolt the holes 42'. As a result, the filter 150 is fixed between the parallel conductive plates 30*a*, 30*b*.

Both ends of the upper and lower conductive plates 30*a*, 30*b* have a structure that vertically extended flanges 32*a*, 32*b* are integrated with the plates as a single body. A plurality of holes 34*a*~34*d*, 34*e*~34*f* for being coupled with different devices, for example, standard rectangular waveguide devices, are formed in both sides of the flanges 32*a*, 32*b*, respectively.

It is preferable that a plurality of tuning screws 40*a*~40*h*, 40*a*'~40*h*' for tuning the resonance frequency of each stage of the dielectric resonator are inserted through both sides of the filter housing 100. For doing so, a nut inserting area 36 for fastening the tuning screws is prepared on the sides of the filter housing 100, and a plurality of holes are formed to insert the tuning screws 40*a*~40*h*, 40*a*'~40*h*' in the nut inserting area 36. In comparison with the prior filter, the filter assembly according to the present invention can remarkably reduce an error occurring during the processing and/or assembling works. Nonetheless, it may be inevitable for the filter assembly to have a minute error compared with its design criteria. Therefore, the tuning screws 40*a*~40*h*, 40*a*'~40*h*' are adopted to compensate to a maximum degree even a minute error which may arise during the processing and assembling of the filter 150 and the filter housing 100. The tuning screws are disposed parallel to, that is, transversely to the traveling direction of the electromagnetic wave, the parallel conductive plates 30*a*, 30*b*. By means of changing a forming pattern of the electric field by adjusting an inserting length of the tuning screws, the tuning screws can compensate errors, which may be introduced during the processing and/or assembling works, in several parameters of the filter assembly.

Figure 8:
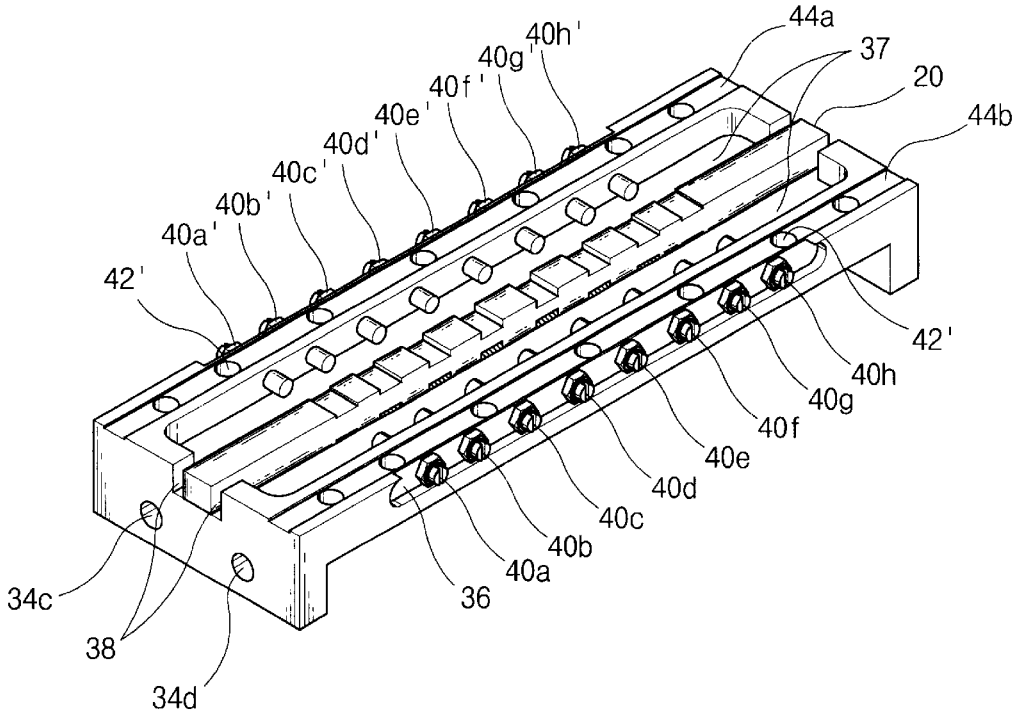
FIGS. 8 and 9 are a perspective view and a plan view respectively illustrating a state that an upper conductive plate is so removed as to explain the structure of the filter assembly illustrated in FIG. 7, a tuning point and a tuning method.
Figure 9:
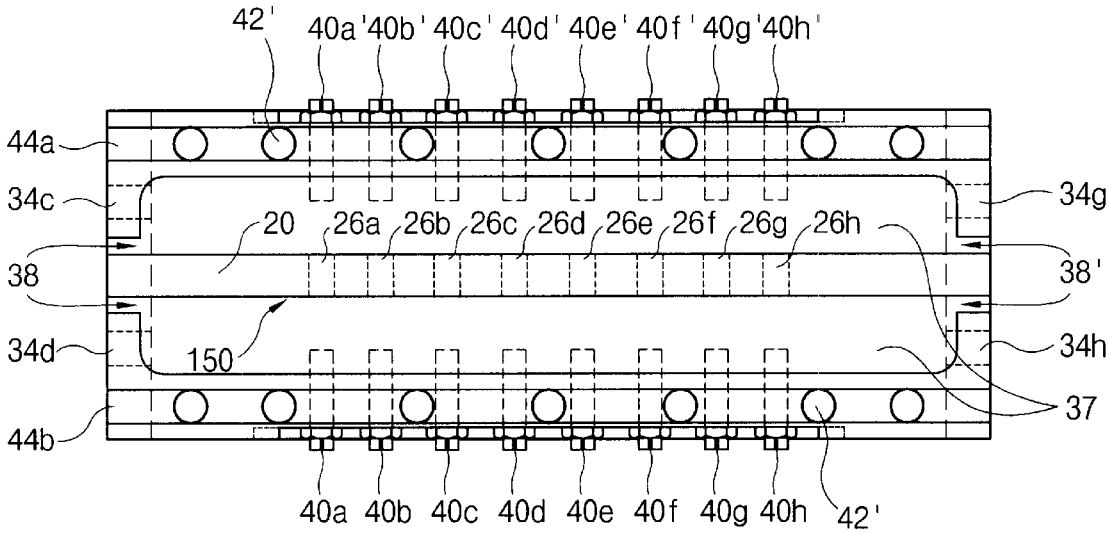
Figure 10:
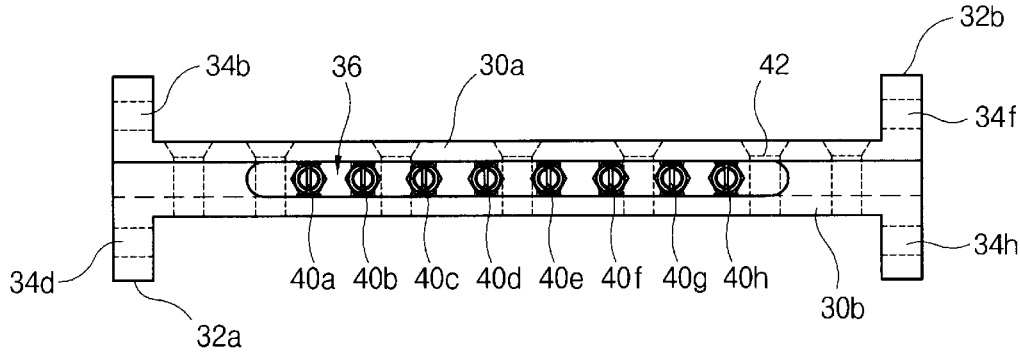
FIGS. 10 and 11 are front views of the filter assembly of FIG. 7 when viewed in the A and B directions, respectively.

FIGS. 8 and 9 are a perspective view and a plan view, respectively, illustrating a state in which the upper conductive plate 30*a* is removed from the filter assembly illustrated in FIG. 7. At the top of the lower conductive plate 30*b*, an inner space 37 of a substantially rectangular shape defined by four sidewalls is provided in the center thereof. Openings 38, 38' are formed on the two sidewalls, facing each other, of the inner space 37. The filter 150 is disposed across the center of the inner space 37 of the lower conductive plate 30*b*, and its both ends are aligned with the ends of the openings 38, 38'. The tuning screws 40*a*~40*h*, 40*a*'~40*h*' are disposed at both sides of the filter 150. It is preferable to design that the tuning screws 40*a*~40*h*, 40*a*'~40*h*' are inserted in and fixed on the two remaining sidewalls of the inner space 37 and each tuning screw points at the center (on the vertical and horizontal axes) of the pair of the metal windows of each stage. FIG. 10 which is a front view of the filter assembly of FIG. 7 when viewed in the A direction shows that the centers of the tuning screws 40*a*~40*h* are positioned in the center of the parallel conductive plates 30*a*, 30*b*, i.e., in the middle height of the dielectric line 20.

Of course, it may be allowed to position each of the tuning screws in the center of the dielectric resonator at each stage, i.e., in the center between two adjacent pairs of the metal windows. In comparison with the above method, this method can reduce the number of the tuning screws whereas it has a difficulty in frequency tuning because the characteristic of the filter varies so sensitively by the inserting length of the tuning screws.

Meanwhile, although the upper and lower conductive plates 30*a*, 30*b* are firmly assembled via screw coupling, they inevitably have a minute crack existing between them. In order to block a leakage of the electromagnetic wave through the minute crack, it is preferable to form wave leakage blocking grooves 44*a*, 44*b* on around the outer circumference of the upper and/or lower conductive plates 30*a*, 30*b*. It is preferable that a width of the grooves is approximately $\lambda/4$ (where $\lambda$ is a wavelength of the electromagnetic wave). The wave leakage blocking grooves can reduce a transmission loss of the filter. FIGS. 8 and 9 show examples that the wave leakage blocking grooves 44*a*, 44*b* are formed on the two sidewalls of the inner space 37 of the lower conductive plate 30*b*.

Figure 11:
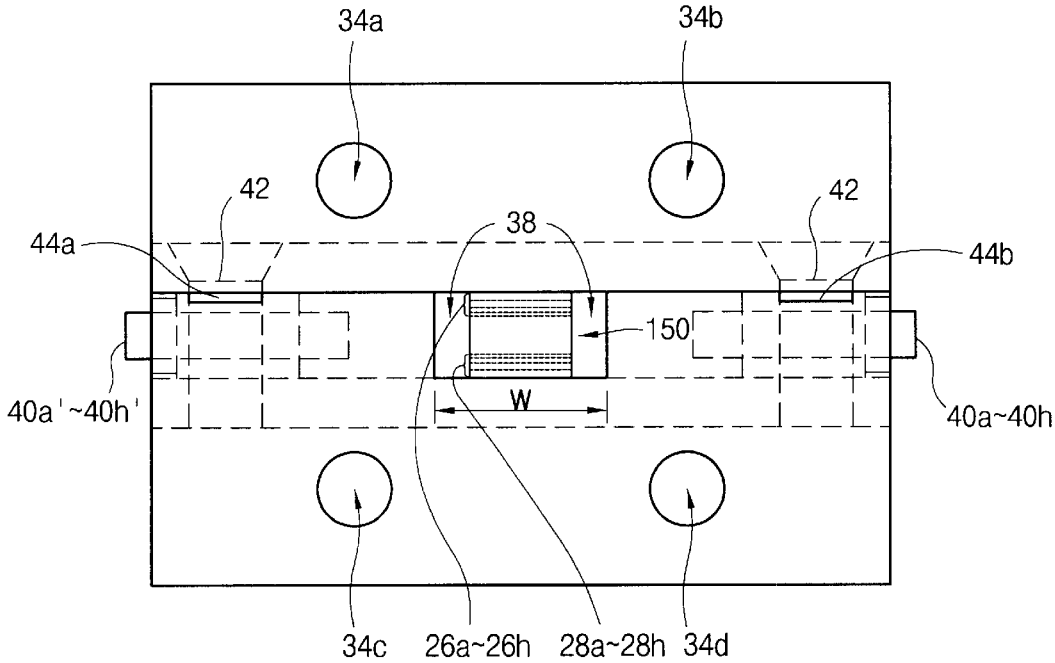

FIG. 11 is a front view viewed from an input/output port of the filter assembly, i.e., in the B direction of FIG. 7. It is preferable to design the flanges 32*a*, 32*b* and their coupling holes 34*a*~34*d*, 34*e*~34*f* to the effect that that the input/output port of the filter assembly is interchangeable with the widely used standard rectangular waveguide (not shown). In order for the input/output port of the filter 150 to have a precise impedance matching with an input or output port of the standard rectangular waveguide, it is particularly preferable to prepare a marginal space for adjusting a setting position by making a width W of the openings 38, 38' formed on the flanges 32*a*, 32*b* wider than a width of the filter 150.

Figure 12:
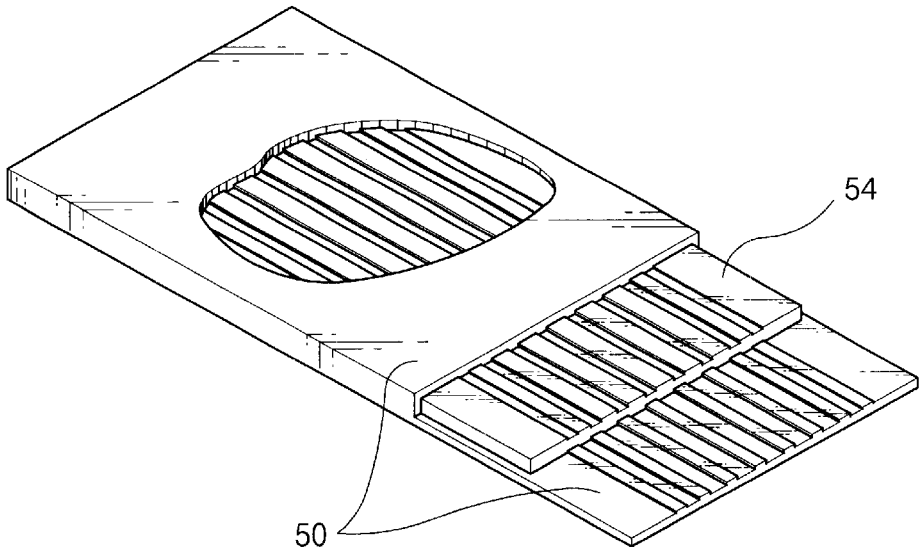
FIG. 12 is a manufacturing process cross-sectional view illustrating that a single body type dielectric line on which metal window inserting grooves are formed can be manufactured by injection molding or extrusion molding.

Meanwhile, the dielectric line 20 according to Embodiment 1 can be manufactured by such various methods as injection molding, extrusion molding, milling processing, and the like. FIG. 12 illustrates a manufacturing process of a single body type dielectric plate on which inserting grooves are formed by injection molding or by extrusion molding.

In the case that the filter 150 is manufactured by injection molding, a mold 50 of which the inner surface matches with the inserting grooves 22*a*~22*h* should first be manufactured. After the mold 50 is manufactured, when a dielectric material is injected into the mold 50 and is cooled in the mold, a plate-shaped dielectric 54 formed with the inserting grooves in which the metal windows are inserted is manufactured. In the case of extrusion molding, after powder of a dielectric material is stuffed into a prepared mold 50 as above and is undergone pressing and forming processes etc., a plate-shaped dielectric body 54 formed with the inserting grooves in which the metal windows are inserted is also manufactured. In the case of processing via a milling machine, a plurality of inserting groove lines are processed, to the extent of a depth D of each inserting groove, on both sides of a plate-shaped dielectric material by an endmill having a measurement identical with a width W of the grooves to be processed. Any one among the above manufacturing methods can be used for mass production.

Figure 13:
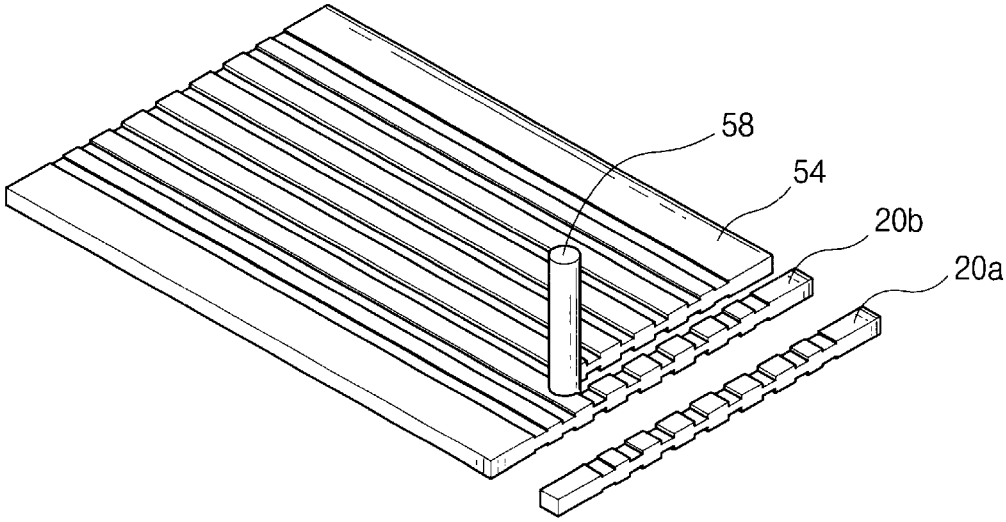
FIG. 13 is a feature illustrating that a plate-shaped dielectric which has been manufactured or processed by the process of FIG. 12 is cut by a milling machine by the regular width.

After the inserting grooves are formed in the plate-shaped dielectric 54 based on the above methods, a plurality of dielectric lines 20*a*, 20*b* . . . in a rectangular stick shape can be obtained by cutting the plate-shaped dielectric 54 by a wanted width with a cutting machine such as a milling machine 58 as shown in FIG. 13. Since many dielectric lines 20*a*, 20*b* . . . can be obtained at once from the plate-shaped dielectric 54, this fact also confirms that the filter assembly according to the present invention has a superior productivity.

Of course, the dielectric line 120 according to the below-mentioned Embodiment 2 can also be manufactured or processed by the above methods.

Figure 14A:
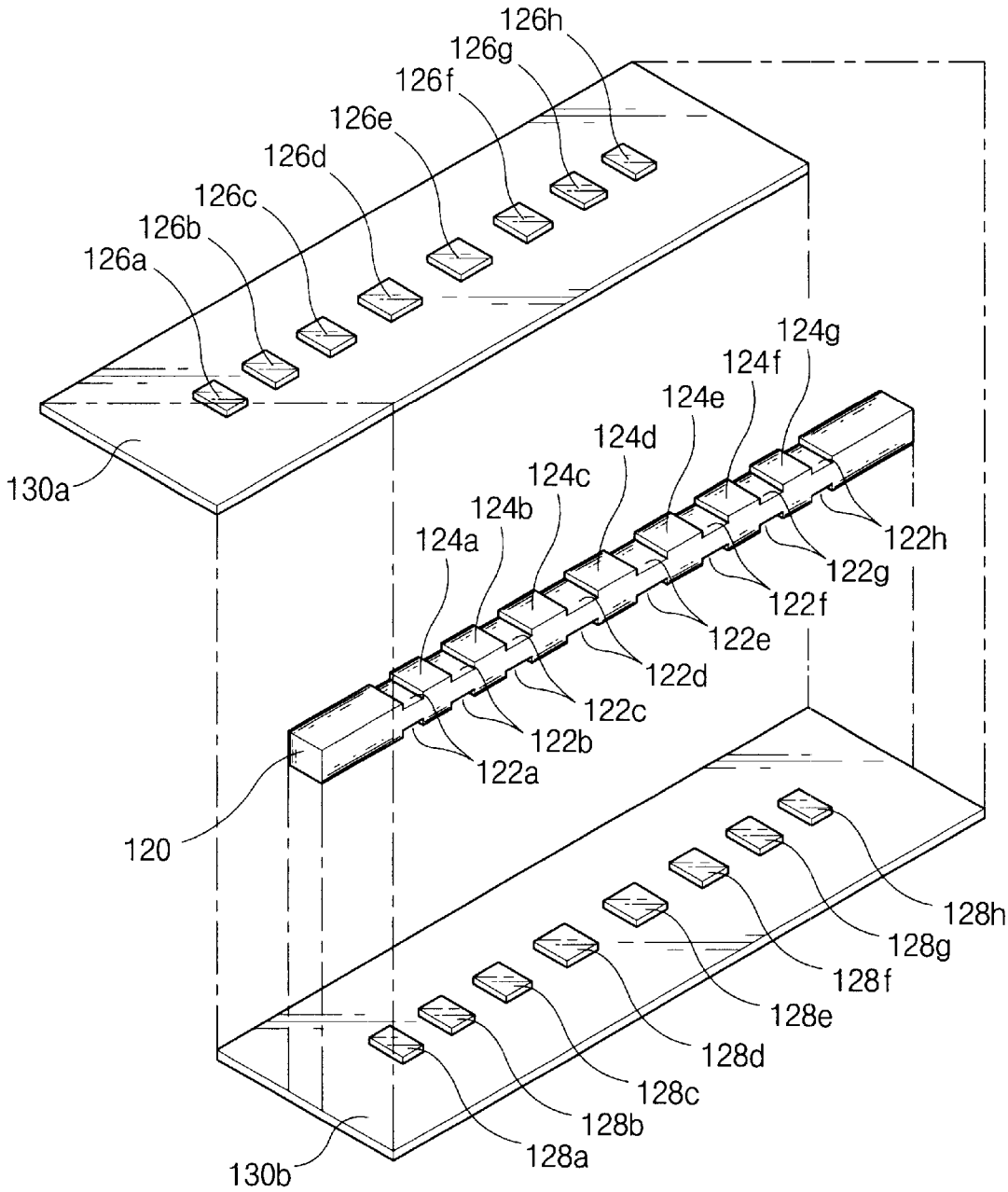
FIGS. 14A and 14B are perspective views, respectively, illustrating a structure of a multi-staged dielectric resonator, as a dielectric line of a metal window filter assembly according to the second embodiment of the present invention, which is divided by a plurality of rectangular inserting grooves, in particular, each depth of the rectangular inserting grooves being identical whereas each width thereof from the middle stage to both end stages becomes gradually narrower.
Figure 14B:
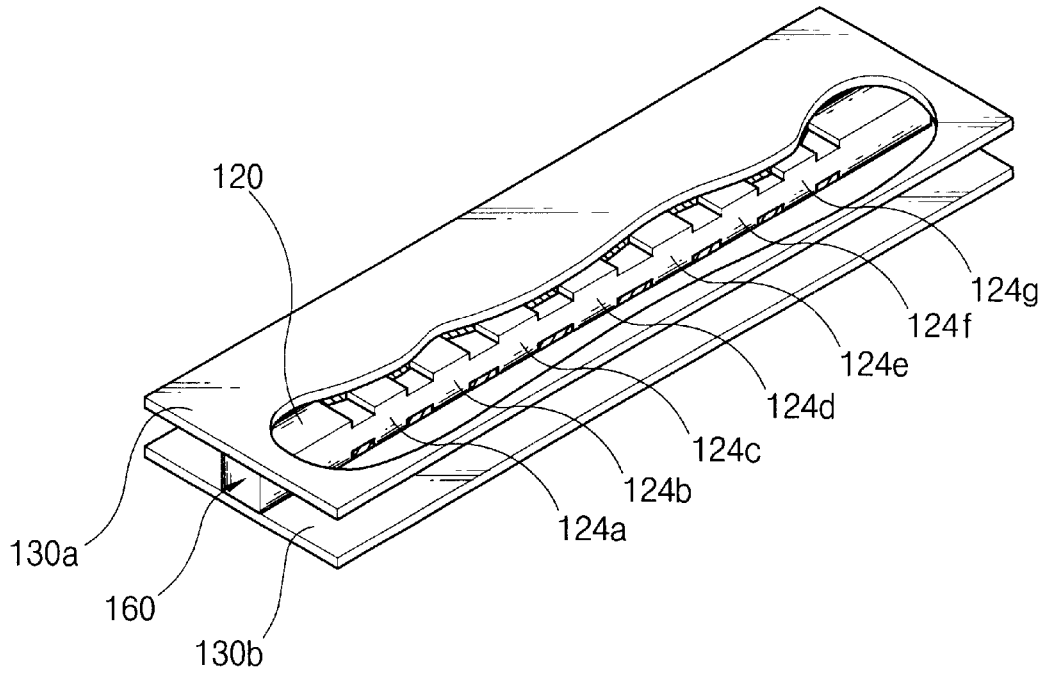

FIGS. 14A and 14B illustrate a metal window filter assembly according to Embodiment 2 of the present invention. The filter assembly of this embodiment has a characteristic that the dimensions of inserting grooves 122*a*~122*h* formed on a dielectric line 120 of a filter 160 and the dimensions of metal windows 126*a*~126*h* which are inserted in these inserting grooves are different from those dimensions of the filter assembly of Embodiment 1. In Embodiment 1, each width W of the inserting grooves is identical. However, in Embodiment 2, the width of the inserting roove of the middle stage is widest among the inserting grooves 122*a*~122*h* and it becomes narrow to both end stages. Likewise, the width L of the metal window of the middle stage is widest among the metal windows 126*a*~126*h*, 128*a*~128*h* and it becomes gradually narrower to both end stages. Further, in Embodiment 1, the depth of the inserting groove of the middle stage is deepest and it becomes gradually shallower to both end stages. In contrast, in Embodiment 2, each depth D of the inserting grooves 122*a*~122*h* is identical and each thickness D of the metal windows 126*a*~126*h*, 128*a*~128*h* is also identical. A length of each of dielectric resonators 124*a*~124*g* is determined in the same way as in Embodiment 1.

The two embodiments according to the present invention are explained as above. According to the metal window filter assembly of the present invention, the filter consists of the multi-staged dielectric resonators which are cascaded as a single body by inserting in the dielectric line a plurality of the metal windows which are divided into several stages in a proper size. Each dielectric resonator has a structure that it makes a symmetrical impedance matching around the middle stage. Accordingly, the filter assembly operates as a band-pass filter which selectively passes only a certain frequency element of the transmitted electromagnetic wave.

The width and depth of the metal windows have an influence on the impedance value of each dielectric resonator. That is, the wider the width of the metal windows is or the thicker the thickness thereof is, the larger the impedance of the corresponding dielectric resonators becomes. In order to constitute the band-pass filter, the impedance value of the dielectric resonator of each stage should be designed in a manner that the impedance value of the middle stage is largest and it becomes small to both end stages. That is, a volume that the metal window of each stage cuts the dielectric lines should be designed to become gradually smaller to the end stages. Both Embodiments 1 and 2 meet such requirements.

However, possible embodiments realizing the basic concept of the present invention are not limited to the above three kinds of embodiments. For instance, the inserting grooves and the metal windows do not necessarily need to be rectangular, but can have other polygonal shapes. Further, various changes can be made to the material of the dielectric line, the number or dimensions of the metal windows, the disposed position of the tuning screws, the shape of the filter housing, or the like.

The metal window filter assembly according to this invention has a superior effect to the prior air gap coupling filter in terms of easiness and precision in processing and assembling, mass productivity and a filter characteristic.

In the case of the prior NRD guide air gap coupled filter, a resonator at each stage exists as a single independent block having a different length from each other and has a structure controlling an impedance of each stage by adjusting a distance between each resonator. Under this structure, it is difficult to precisely process dielectric blocks, and more difficult to arrange the independent dielectric block of each stage with maintaining a certain distance in the right position within a filter housing.

In comparison with this, according to the metal window filter assembly of the present invention, the inserting grooves can be formed simply and precisely by using injection molding, extrusion molding, or a milling machine in the pre-designed dimensions and position of the dielectric line which is difficult for being precisely processed. And also, the filter assembly has superiority in mass production because the metal windows are designed to have the same width or depth in consideration of the case that the NRD line is injection molded or extrusion molded and because the dielectric line has a single body.

In the case that the dielectric line is fixed on the parallel conductive plates during the filter assembly, the filter assembly is advantageous to arrange the plates in the right position with maintaining the precision of several microns without having an extra supporter. That is, the filter can be made by simply inserting the metal windows in pre-designed dimensions in each of the inserting grooves. A possibility that the filter characteristic is changed by an additional assembly error which may arise during assembling works can be fundamentally excluded. In particular, if the metal windows are formed as a single body type with the parallel conductive plates, assembling will be very simple by setting the dielectric line between the parallel conductive plates and screwing them. The filter structure of the millimeter wave band which requires the precision of several microns can be easily assembled without having an extra auxiliary zig. Therefore, the processing convenience and the shortened assembly time can maximize the productivity of the filter assembly.

And also, since the filter assembly of the present invention is designed to minimize the factors of error occurrence during the processing and assembly, the filter can have a preferable filtering characteristic which is intended at the designing stage. The filter assembly can obtain a perfect filter characteristic because even a minute error is completely compensated by adding a tuning screw.

Further, even if the filter assembly of the present invention is operated by being applied to a communication system for a long period of time, there is no problem that the resonator blocks are misaligned due to thermal deformation or impact, and thus the filter assembly can contribute to the stable operation of the communication system. In comparison, with the prior air gap coupled filter, the metal window filter assembly proposed by the present invention has a suitable structure for a commercial use due to a less loss and its superiority in processing and assembling.

While the present invention has been particularly shown and described with reference to a particular embodiment thereof, it will be understood by those skilled in the art that various changes and modifications can be made within the scope of the invention as hereinafter claimed. Therefore, all the changes and modifications of which the meaning or scope is equal to the scope of the claims of the present invention belong to the scope of the claims thereof.

What is claimed is:

1. A metal window filter assembly using a non-radiative dielectric waveguide, comprising:

a filter housing which includes parallel conductive plates facing each other; and a filter, disposed between said parallel conductive plates, for filtering a certain frequency band of an electromagnetic wave traveling therethrough, said filter including a plurality of polygonal metal windows and a single body type dielectric line made from a non-radiative dielectric, said dielectric line being formed with a plurality of polygonal inserting grooves which are spaced by the predetermined distance on first and/or second surfaces of said dielectric line making contact with said parallel conductive plates, and said metal windows being inserted in said inserting grooves one to one to form multi-staged dielectric resonators cascaded as a single body, wherein said filter has a filtering function selectively passing the certain frequency band determined by an impedance coupling relationship that said multi-staged dielectric resonators have with respect to the electromagnetic wave.

2. A metal window filter assembly using a non-radiative dielectric waveguide as claimed in claim 1, wherein an impedance of said multi-staged dielectric resonators is largest in a middle stage and becomes gradually and symmetrically smaller to both end stages.

3. A metal window filter assembly using a non-radiative dielectric waveguide as claimed in claim 1, wherein each of said inserting grooves has an identical width whereas depths of said inserting grooves become gradually and symmetrically deeper to a middle stage and wherein each of said metal windows has a substantially identical height with a depth of an inserting groove in which each such metal window is inserted and a depth of each of said metal windows is slightly wider than a width of an inserting groove in which each such metal window is inserted.

4. A metal window filter assembly using a non-radiative dielectric waveguide as claimed in claim 1, wherein each of said inserting grooves has an identical depth whereas widths of said inserting grooves become gradually and symmetrically deeper to a middle stage and wherein each of said metal windows has a substantially identical height with a depth of an inserting groove in which each such metal window is inserted and a depth of each of said metal windows is slightly wider than a width of an inserting groove in which each such metal window is inserted.

5. A metal window filter assembly using a non-radiative dielectric waveguide as claimed in claim 1, wherein each of said metal windows is fixed as a single body on said parallel conductive plates.

6. A metal window filter assembly using a non-radiative dielectric waveguide as claimed in claim 1, wherein a length of each stage of said dielectric resonators divided by said metal windows becomes gradually shorter from a middle stage to both end stages.

7. A metal window filter assembly using a non-radiative dielectric waveguide as claimed in claim 1, further comprising a plurality of tuning screws inserted, parallel to said parallel conductive plates toward said dielectric line, through both side walls of said filter housing, for tuning a resonance frequency of the filter by adjusting insertion lengths of said tuning screws.

8. A metal window filter assembly using a non-radiative dielectric waveguide as claimed in claim 7, wherein each of said tuning screws is disposed to point a center between upper and lower metal windows of each stage.

9. A metal window filter assembly using a non-radiative dielectric waveguide as claimed in claim 1, wherein a wave leakage blocking groove for blocking a leakage of said electromagnetic wave is s o formed on a lower surface of an upper conductive plate of, and/or on an upper surface of a lower conductive plate of, said parallel conductive plates as to surround said dielectric line.

10. A metal window filter assembly using a non-radiative dielectric waveguide as claimed in claim 1, wherein an opening is so formed on both flanges of said filter housing as to expose both ports of said dielectric line, a width of said opening being so wider than a width of said dielectric line as to provide a marginal space for securing that the ports of said dielectric line are precisely coupled to an input/output port of another device.

11. A metal window filter assembly using a non-radiative dielectric waveguide as claimed in claim 1, wherein a length of each stage of said dielectric resonators divided by said metal windows becomes gradually shorter from a middle stage to both end stages.

* * * * *